United States Patent [19]

Gropp

[11] Patent Number: 4,922,802

[45] Date of Patent: May 8, 1990

[54] METHOD OF DETERMINING ELEVATION ANGLE CORRECTION VALUE FOR A GUN

[75] Inventor: Heiko Gropp, Hamburg, Fed. Rep. of Germany

[73] Assignee: Rheinmetall GmbH, Dusseldorf, Fed. Rep. of Germany

[21] Appl. No.: 393,872

[22] Filed: Aug. 15, 1989

[30] Foreign Application Priority Data

Aug. 16, 1988 [DE] Fed. Rep. of Germany ..... 3827764

[51] Int. Cl.[5] ..... F41G 3/16; G01S 13/58

[52] U.S. Cl. ..... 89/41.07; 342/67

[58] Field of Search ..... 89/41.06, 41.07; 342/67; 356/152

*Primary Examiner*—Stephen C. Bentley

*Attorney, Agent, or Firm*—Spencer & Frank

[57] ABSTRACT

A method for determining an elevation angle correction value for a gun barrel which fires a projectile. An elevation angle for the gun barrel for a desired point of impact of a projectile is calculated and the projectile is fired from the gun barrel. A first measurement of the trajectory of the projectile is made at a point within the ascending portion of the trajectory. A second measurement of the trajectory of the projectile is made at a point within the descending portion of the trajectory. The first and second measurements are used to calculate the actual trajectory of the projectile from which the actual point of impact of the projectile is determined. The elevation angle correction value is determined from the deviation between the desired point of impact and the actual point of impact.

2 Claims, 2 Drawing Sheets

METHOD OF DETERMINING ELEVATION ANGLE CORRECTION VALUE FOR A GUN

CROSS REFERENCE TO RELATED APPLICATION

This application claims the priority of Application Ser. No. P 38 27 764.6 filed Aug. 16th, 1988 in the Federal Republic of Germany, the subject matter of which is incorporated herein by reference.

BACKGROUND OF THE INVENTION

The present invention relates to a method for determining an elevation angle correction value for a gun barrel relative to a desired point of impact of a projectile fired from the barrel by determining a deviation between the desired point of impact and the actual point of impact of the projectile.

In prior art methods of this type, the trajectory of the projectile is tracked for about $\frac{2}{3}$ of its time of travel. During this time a trajectory tracking radar device radiates electromagnetic waves, enabling the enemy to locate the radar device and thus the gun.

SUMMARY OF THE INVENTION

It is an object of the present invention to improve a method of the above mentioned type so that it becomes much more difficult to locate the gun by detection of the radar measurement signal.

The above and other objects are accomplished in accordance with the invention wherein there is provided a method for determining an elevation angle correction value for a gun barrel which fires a projectile, including: calculating an elevation angle for the gun barrel for a desired point of impact of a projectile to be fired from the barrel; firing a projectile from the gun barrel; making a first measurement of the trajectory of the projectile at a point within the ascending portion of the trajectory; making a second measurement of the trajectory of the projectile at a point within the descending portion of the trajectory; using the first and second measurements to calculate the actual trajectory of the projectile; determining the actual point of impact from the actual trajectory; and determining the elevation angle correction value from the deviation between the desired point of impact and the actual point of impact.

The present invention is based essentially on the fact that the radar device need be switched on only for two short periods of time, thus making it more difficult for the enemy to locate it.

Another advantage of the invention is that the energy supply for the radar device is kept low. The high energy required for only a short period of time can be stored beforehand.

BRIEF DESCRIPTION OF THE DRAWINGS

Further details of the invention will now be described with the reference to the drawing figures, wherein.

DETAILED DESCRIPTION OF A PREFERRED EMBODIMENT

Figure 1:
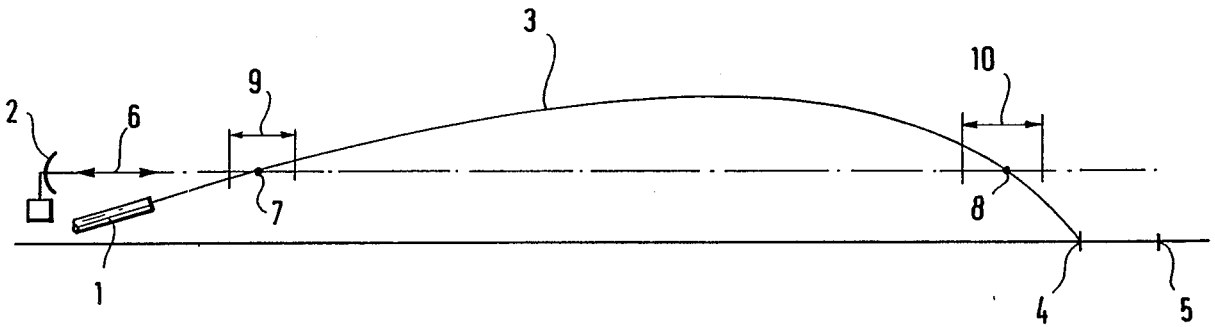
FIG. 1 is a schematic which shows a gun barrel and radar device of an armored howitzer, and a projectile trajectory.

Referring to FIG. 1, there is shown a gun barrel 1 of an armored howitzer and a radar device 2 which measures the momentary trajectory of a projectile (not shown). The actual trajectory of the projectile is marked 3, its point of impact is marked 4 and the theoretical point of impact resulting from the elevation angle of the gun barrel is marked 5. A radar measuring beam 6 emanates from radar device 2 and intersects the actual trajectory 3 of a projectile at a first measurement location 7 and at a second measurement location 8. Measurement locations 7 and 8 lie within measurement expectation intervals 9 and 10.

Figure 2:
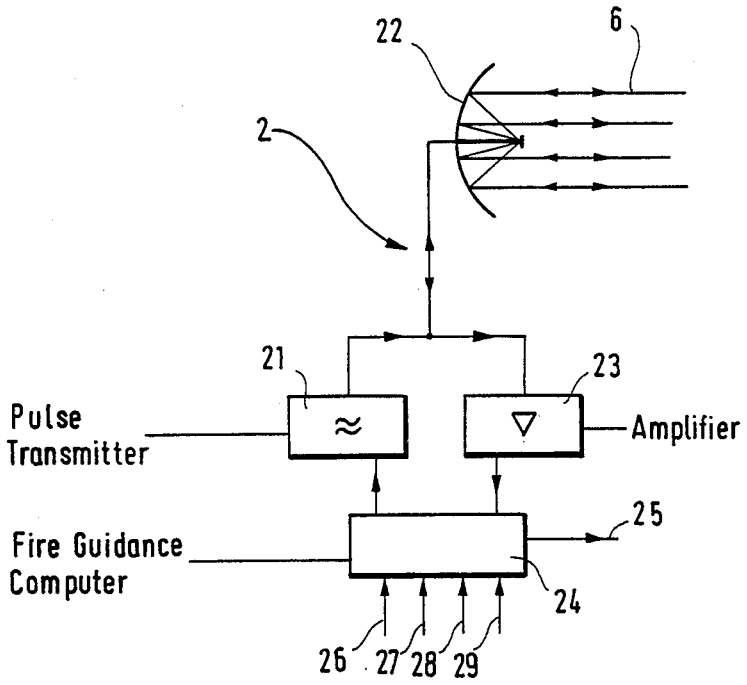
FIG. 2 is a block circuit diagram and schematic illustrating an embodiment of a radar measuring device according to the invention.

FIG. 2 is a schematic representation of a pulse radar device 2 employed for carrying out the method according to the invention. A pulse transmitter 21 is connected to an antenna 22, for delivering radar pulses thereto. An amplifier 23 is connected to antenna 22 for receiving and amplifying signals reflected from the projectile. A fire guidance computer 24 is connected to transmitter 21 for sending control signals to the transmitter and is connected to amplifier 23 for receiving amplified return signals therefrom.

The method according to the invention will now be described.

Initially, an elevation angle for the gun barrel is determined a known manner on the basis of given parameters for the respective type of projectile, charge and the desired point of impact, and these values are transferred to the weapon in a manner known to those skilled with such weapons. The weapon is thereafter made ready for firing and fired. According to prior projectile tracking methods, the entire trajectory 3 or a substantial portion thereof would be continuously surveyed. However, in accordance with the principles of the present invention, trajectory 3 is measured by measuring the trajectory of the projectile at two specific locations or points. For this purpose, measurement point 7 is determined in the ascending portion of trajectory 3 and measurement point 8 in the descending portion of trajectory 3.

Because the firing information regarding charge, type of projectile and elevation determines the values for a theoretical trajectory, transmitter 21 can be switched by way of computer 24 so that it transmits pulses only during two measurement expectation intervals 9 and 10. From measured values of distance and slope of the projectile at measurement points 7 and 8, the actual trajectory 3 of the projectile can be extrapolated with the aid of fire guidance computer 24 as will be appreciated by those skilled in the art and any required appropriate elevation angle correction value is forwarded via a line 25 to gun adjustment drives (not shown).

Lines 26 to 29 identified in FIG. 2 serve for the input of data relevant for the elevation angle determination, such as type of projectile, charge, powder temperature, etc.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A method for determining an elevation angle correction value for a gun barrel which fires a projectile, comprising:

calculating an elevation angle for the gun barrel for a given point of impact of a projectile to be fired from the barrel;

firing a projectile from the gun barrel;

making a first measurement of the trajectory of the projectile at a point within the ascending portion of the trajectory;

making a second measurement of the trajectory of the projectile at a point within the descending portion of the trajectory;

using the first and second measurements to calculate the actual trajectory of the projectile;

determining the actual point of impact from the actual trajectory; and determining the elevation angle correction value from the deviation between the given point of impact and the actual point of impact.

2. A method as defined in claim 1, wherein said steps of making a first measurement and making a second measurement include using one of a radar device and a laser device to make the measurements by radiating transmitted pulses only during a first predetermined measurement expectation interval for making the first measurement and only during a second predetermined measurement expectation interval for making the second measurement.

* * * * *